United States Patent [19]

Overstreet

[11] Patent Number: 5,071,063

[45] Date of Patent: Dec. 10, 1991

[54] SECURITY MAIL RECEPTACLE

[76] Inventor: Tannis L. Overstreet, 4117 Fonseca Ave., Sebring, Fla. 33872

[21] Appl. No.: 620,093

[22] Filed: Nov. 30, 1990

[51] Int. Cl.[5] ..... B65D 91/00

[52] U.S. Cl. ..... 232/17; 232/43.1; 232/39

[58] Field of Search ..... 232/17, 43.1, 39

[56] References Cited

U.S. PATENT DOCUMENTS

| | | | |
|---|---|---|---|
| 3,880,344 | 4/1975 | Earle | 232/17 |
| 4,186,869 | 2/1980 | Brown | 232/17 |
| 4,724,999 | 2/1988 | Fitzgerald et al. | 232/17 |
| 4,753,386 | 6/1988 | Phillion | 232/43.1 |
| 4,793,551 | 12/1988 | Baylor | 232/17 |
| 4,877,332 | 7/1989 | Long | 232/17 |
| 4,905,891 | 3/1990 | Wildish et al. | 232/17 |
| 4,934,592 | 6/1990 | DiMenichi | 232/17 |

*Primary Examiner*—Robert W. Gibson, Jr.
*Attorney, Agent, or Firm*—Edward M. Livingston

[57] ABSTRACT

A security mail receptacle having a mail-receiving portion 1 mounted on a hollow support pole 1*a* is provided. The mail-receiving portion 1 contains an opening 11 on the inside bottom thereof through which delivered mail falls into the hollow support pole 1*a*. A tray 4 inside the mail-receiving portion 1, which is separated by a dividing wall 2 from the opening 11, holds outgoing mail for pickup by a Postal Service worker. The delivered mail is retrieved by the resident merely by unlocking a door 15 on the back side of the hollow support pole 1*a*. The hollow support pole 1*a* may be mounted on the ground or on a concrete support base 7. Optional handles, one 19 on the mailbox door 9 and the other 20 on the mailbox 1, are provided to aid in opening and closing the mailbox door 9 and for locking said door with a padlock 21 to prevent delivery when mail has been forwarded.

8 Claims, 2 Drawing Sheets

SECURITY MAIL RECEPTACLE

BACKGROUND OF THE INVENTION

This invention relates to mail receptacles and more particularly to a mailbox having a security compartment contained therein.

Currently, rural streetside mailboxes provide no security for mail placed therein. Once mail is placed within the mailbox, thieves can steal it. The mail may include important items and even checks, such as social security checks for the elderly, and thus theft of such mail could result in serious hardship to the recipient. Due to the possibility of such thefts, residents often wait and observe the mailbox until the mail is delivered whereupon they immediately go to the mailbox to get the mail. However, if the mailbox cannot be seen from the person's residence, a resident does not know when the mail is delivered, and therefore may make several trips to the mailbox only to find that the mail has not been delivered yet. Also, rain, snow or other inclemate weather makes it difficult for the residents, again especially the elderly, to get the mail immediately. Thus it is even more frustrating for senior citizens to walk to the mailbox only to find that no mail has been delivered.

Another problem with current mailboxes is that when the resident is absent, unless mail delivery is halted for the period of the absence, mail accumulates within the mailbox. The accumulation of mail is an indication to all that the resident is absent, thereby making burglary of the residence more attractive.

Many homes have mailboxes attached to the house or a slot in the door which eliminates some of the abovementioned security problems. However, by 1995, the Postal Service is requiring that all mailboxes be streetside. Thus, there is a need for a streetside mail receptacle that will provide security for both the mail and that will allow the residents to retrieve the mail at his or her convenience.

Another problem with current mailboxes which is addressed by this invention is the occurrence of mail delivery to a particular address after the mail has been forwarded by the resident. Often mail will continue to accumulate after a resident has moved and left a forwarding address making such mail subject to loss or theft.

Others have attempted to provide mailboxes to overcome the problem of the lack of security but none is like the present invention. The most relevant patented art includes the following: U.S. Pat. No. 4,793,551 by Baylor granted Dec. 27, 1988; U.S. Pat. No. 4,905,891 by Wildish et al. granted Mar. 6, 1990; U.S. Pat. No. 4,815,656 by Smith et al. granted Mar. 28, 1989; German Patent No. 1,144,644 granted Feb. 28, 1963 and French Patent No. 1,365,602 granted June 21, 1963.

The most relevant of the above patents is U.S. Pat. No. 4,793,551 which discloses a mailbox with a door in the bottom inside thereof. The door in this invention must be picked up each time the mail is delivered in order for the mail to be placed therein and fall into the hollow supporting pole. Since this door must be opened by the mailman every time the mail is delivered, this slows down the delivery of the mail and is a hassle to the mailman in general.

U.S. Pat. No. 4,905,891 shows another security mailbox having a slanted upper portion containing a throated section to allow the mail to fall into a lower section and be retrieved from a locked door in the bottom thereof. As presented, however the mailbox contains very little room for holding large amounts of mail in a secured fashion and is substantially different in structure and appearance from standard mailboxes in use today.

The mailbox disclosed in U.S. Pat. No. 4,815,656 shows a complex mailbox which uses an elongated rod moved to various positions to lock and unlock the mailbox.

The German Patent No. 1,144,644 shows another mailbox with a trap door in the bottom thereof.

Finally, the French Patent appears to show merely a means for signaling when the mail has been delivered.

Unlike the prior patented inventions, the design of the present invention is such that the mailbox itself appears like a standard mailbox and does not obstruct or change a letter carrier's normal delivery procedure. The present invention would eliminate the theft of mail and allow residents to relax when waiting for the mail or when they are away from home and unable to collect their mail. The mail-receiving portion of the receptacle appears like a standard mailbox and is mounted on a broad base rather than a slim pole. The receiving portion has a partial bottom to hold envelopes for outgoing mail and a large opening to allow delivered mail to fall into the base where it cannot be reached through the door of the mailbox. Residents may then remove the mail at their leisure by using a key to unlock a panel in the bottom of the base. Two handles, one on the mailbox door and the other on the mailbox, and each having a matching hole therein are provided for securing the door closed after forwarding or stop orders have been given to the Postal Service.

SUMMARY OF THE INVENTION

The primary object of the present invention is to provide a mail receptacle that will help prevent theft of mail placed therein.

Another object of the present invention is to eliminate continual or frequent surveillance by residents waiting for their mail.

A further object of the present invention is to eliminate the stress and anxiety caused by the fear of having important mail stolen or lost.

An even further object of the present invention is to provide a mail receptacle that will retain large quantities of mail which may be delivered or built up during a resident's absence.

A related object of the present invention is to eliminate the need to contact the letter carrier, Postal Service or a neighbor when a resident is out of town to have the mail put on hold or have someone pick it up during his or her absence.

A further object of the present invention is to provide a mail receptacle that will allow a resident to get mail at his or her convenience.

An additional object of the present invention is to provide a mail receptacle that will protect the mail from adverse weather and other elements.

An optional object of the present invention is to provide a means to prevent mail from being delivered and accumulating in the mailbox after a resident has moved and left a forwarding address with the Postal Service.

Another object of the present invention is to provide a mail receptacle that increases the visibility of the mailbox to motorists, thereby possibly reducing collisions therewith.

The present invention accomplishes the above and other objects by providing a mail receptacle having a mail-receiving portion mounted on a hollow support pole. The mail-receiving portion has the appearance of a standard mailbox with a front opening covered by a hinged, pivotably-mounted door with the exception that it has an opening in the bottom inside the mail-receiving portion to allow delivered mail to fall into the hollow support pole. A holding section for holding outgoing mail until it is picked up by a Postal Service worker is provided inside the mail-receiving portion. The holding section comprises a tray which runs lengthwise from front to back on the bottom of the mail-receiving portion. The tray is separated from the delivered mail opening by a vertical dividing wall having sufficient height so the outgoing mail will not fall into the opening.

The hollow support pole contains a locked door, preferably on the back side facing away from the street and toward the residence. When the mail is delivered, it falls into the hollow support pole and is retrieved by the resident by unlocking the door and swinging same open. The hollow support pole may be mounted on a concrete base to support same above ground level. Concrete screws may be provided for inserting into the bottom of the hollow base portion and may be screwed into the concrete base. The access to said screws is provided through the unlocked door in the support pole.

An optional means of precluding mail delivery after a resident has moved and left forwarding instructions is provided by two handles, one on the mailbox door and the other on the top of the mailbox, each of which have matching holes that line up when the mailbox door is closed such that a padlock can be placed thereon by the resident or a Postal Service worker.

The above objects and other objects will become more readily apparent when discussed in conjunction with the detailed description of the preferred embodiment and the drawings.

BRIEF DESCRIPTION OF THE DRAWINGS

The drawings used to describe in detail the preferred embodiment of the invention are as follows.

DESCRIPTION OF PREFERRED EMBODIMENTS

Figure 1:
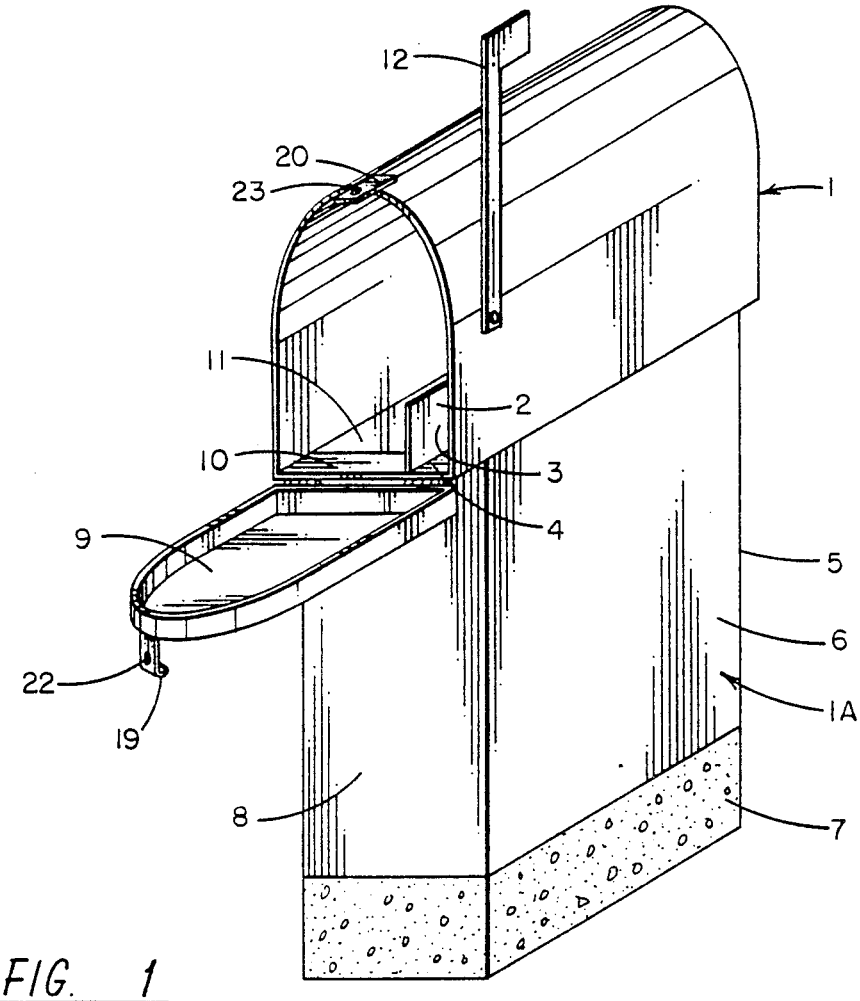
FIG. 1 is a front perspective view of the security mail receptacle with front door open.

In reference to FIG. 1 there are two major components of the present invention, the mail-receiving portion 1 and the hollow support pole la are illustrated. The mail-receiving portion 1 appears from the outside like a standard mailbox having a pivotably-mounted door 9 on the front side and enclosed on all other sides. On the inside, however, is where the present invention differs from the standard mailbox in that rather than being enclosed on the bottom it has an opening 11 behind a lip 10 in the bottom of the mail-receiving portion 1 into which delivered mail is placed. The mail-receiving portion 1 further contains an outgoing mail section 3 into which a person may place outgoing mail for pickup be a Postal Service worker. As illustrated, this mail-receiving portion 1 has a floor 4 running the length of the mailbox 1 separated from the opening 11 by a vertical dividing wall 2. The hollow support pole 1*a* may be rectangular in shape having shorter front and back sides, 8 and 5, respectively, and longer sides 6. As illustrated the support pole 1*a* may be secured to a base 7 which may be made of concrete, or almost any other strong material.

Figure 3:
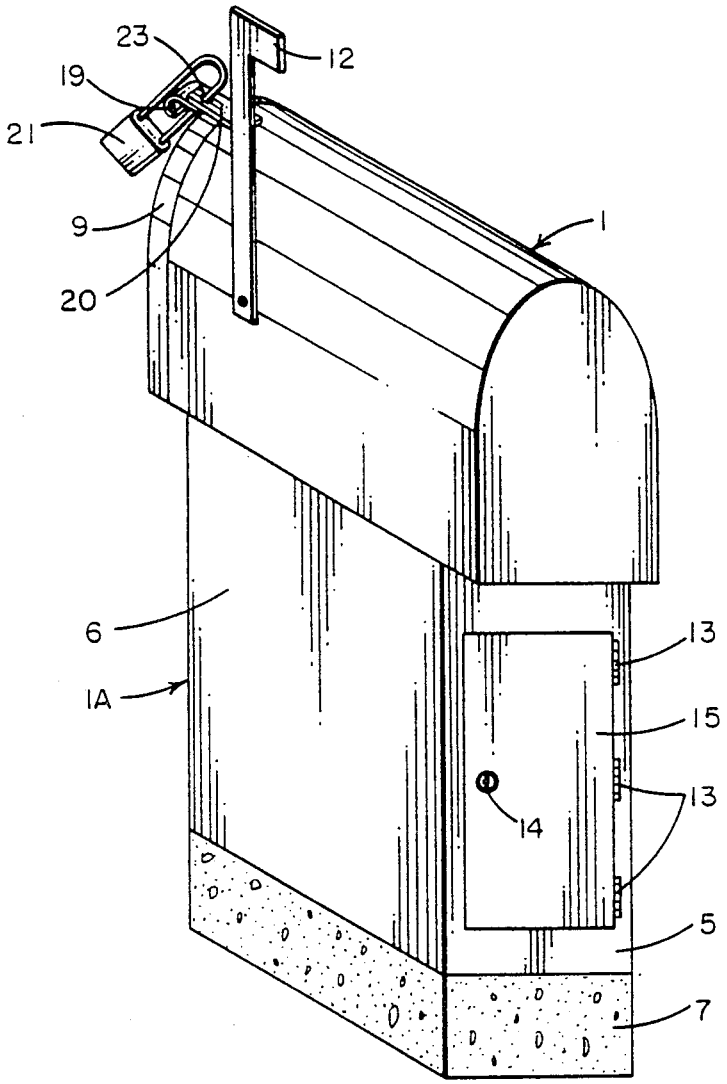
FIG. 3 is a rear perspective view of the security mail receptacle signal flag in upright position.

Also in FIG. 1, two handles, one 20 on the mailbox 1 and the other 19 on the door 9 are provided with holes 23 and 22, respectively, therein. The holes match up with each other when the door 9 is closed. The mailbox door handle 19 assists a Postal Service worker in opening and closing the door 9 and may be curved downward at its outermost extension to make it easier to use. When the door 9 is closed it may be secured and locked as shown in FIG. 3 by placing padlock 2 through the holes 23 and 22. By locking the door 9 closed, a resident who has moved can insure that mail is being forwarded as desired and not accumulating as often happens.

Figure 2:
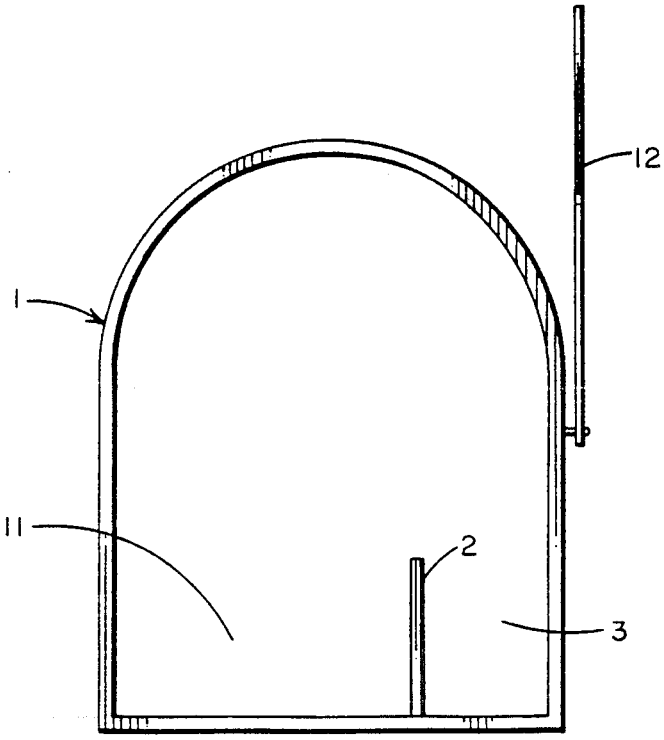
FIG. 2 is a front view of the mail-receiving portion of the security mail receptacle.

Referring now to FIG. 2, FIG. 2 shows the mail-receiving portion 1 without the front door 9, as it would appear from the front. The two sections of one receptacle 11 are the opening 11 for receiving the incoming mail and the holding section 3 for outgoing mail, divided by a vertical dividing wall 2. The mail-receiving portion 1 may also contain a flag 12 pivotably-mounted on the side thereof in order to signal a Postal Service worker there is mail in the holding section 3 for pickup.

In FIG. 3, the access door 15 is shown on the back side 5 of the hollow support pole 1*a*. The door 15 is shown as being pivotably-mounted on hinges 13. A lock 14 opposite the hinges 13 may be opened by a key to retrieve any mail contained inside and then relocked.

Figure 4:
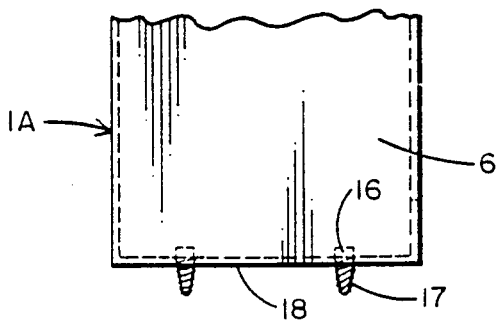
FIG. 4 is a partial side plan view of the bottom of the support pole of the security mail receptacle.

FIG. 4 shows a partial plan view of the bottom portion of the hollow support pole la from a side 6 showing screws or supporting cones 17 mounted on the bottom surface 18 of the hollow support pole 1*a*. The screws are secured through holes by tops or nuts 16. These screws may be reached through the back access door 15 when opened and screwed into pre-drilled holes in the base 7.

The present invention is manufactured preferably of metal or plastic but may be made of almost any rigid material. Although the present invention could be made in two separate pieces consisting of the mail-receiving portion 1 and the hollow support pole 1*a* and then assembled as one, preferably the sections would be made in one piece of metal or plastic. Although the present invention could merely be mounted or set in the ground on its bottom 18, preferably the invention would be sold with a concrete mounting base 7 with concrete screws 17 to be secured through holes in the bottom 18 of the hollow support pole 1*a*. Furthermore, to make it easier for the consumer, the entire invention could be sold as one piece already mounted on a concrete base 7 for immediate installation so that perhaps the consumer would only have to did a very shallow hole for which to partially insert the base 7.

The use and operation of the present invention is easy since residents and Postal Service workers are already familiar with how to use the standard mailbox. The major difference in outgoing mail procedure with this security mail receptacle is that residents would be required to put outgoing mail in the tray 4. With regard to delivery, the Postal Service worker would deliver the mail in the usual manner by opening the front door 9 but would insert the mail into the opening 11 which would automatically fall into the hollow support pole 1*a*. The mail would then be secure from being reached from the front of the mailbox. A Postal Service worker then would remove any mail from the outgoing mail section 3 and then close the front door 9. Then a Postal Service worker would lower the flag 12 to signal delivery of the mail. The resident would retrieve the mail merely by inserting a key into the lock 14 to unlock the door 15 and swing it open on its hinges 13. The resident would reach inside and retrieve the mail and then close the door by swinging the door shut and locking it.

The present invention, including the mail-receiving portion 1 and hollow support pole 1*a* would preferably be made of metal or plastic, but could be almost any rigid material. These components could be made of two pieces but would be preferably be made of one piece either during manufacturing or connected thereafter and sold as one piece so it could easily be mounted on the ground. Although the invention may be mounted merely by resting the bottom of the support pole 18 on the ground, it could be mounted on a base such as concrete 7 and secured thereto by concrete screws 17. For maximum ease however, the entire invention could be sold already assembled in one piece and could be easily put to use by either resting it on the ground or by digging a very shallow hole the shape of the base to further support the invention.

The objects and advantages of this invention as set forth previously should be readily apparent from the detailed description of the preferred embodiment. Although only one preferred embodiment has been disclosed in the description and drawings, it should be understood that all alterations, modifications and changes and the equivalents are covered by this invention within the scope of the claims.

Having described the preferred embodiments of my invention, I claim:

1. A security mail receptacle comprising:

a hollow support pole having a locking door in one side thereof said locking door which may be unlocked and swung open to obtain mail and then closed and relocked;

a mail-receiving portion on top of said support pole, said mail-receiving portion being entirely enclosed, except for a front opening covered by a hinged pivotably-mounted door and an opening in the bottom inside to allow delivered mail to fall into the hollow support pole, and also having a section for holding out-going mail until it is picked up by a Postal Service worker, wherein the section for holding outgoing mail comprises a tray in a portion of the bottom of the mail-receiving portion, said tray having a floor running lengthwise from front to back of the receiving portion with a vertical dividing wall to separate said outgoing mail section from the opening in the bottom of the mail-receiving portion.

2. The security mail receptacle of claim 1 wherein the locking door in the hollow support pole is located on the side of the support pole facing toward a residence.

3. The security mail receptacle of claim 2 wherein the locking door is pivotably-mounted on hinges.

4. The security mail receptacle of claim 2 wherein the mail-receiving portion further comprises a flag pivotably-mounted on the outside of said receiving portion such that the flag can be raised to a vertical position to signal mail is in the section for outgoing mail for pickup by a Postal Service worker.

5. The security mail receptacle of claim 2 wherein the hollow support pole is further mounted on a concrete base to support same above ground level.

6. The security mail receptacle of claim 5 wherein the hollow support pole is rectangular in shape with front and back sides being shorter than the sides of the support pole.

7. The security mail receptacle of claim 5 wherein the hollow support pole further contains concrete screws in the bottom thereof to secure same to the concrete base.

8. The security mail receptacle of claim 1, further comprising two handles on the mail-receiving portion, one extending from the top front of the pivotably-mounted door and another extending outwardly from the top front of the mail-receiving portion, each handle having a hole therethrough, said holes which align when the door is closed to allow a padlock-like locking device to be placed therethrough.

* * * * *